US005298387A

United States Patent [19]

Maskasky

[11] Patent Number: 5,298,387

[45] Date of Patent: * Mar. 29, 1994

[54] PROCESS FOR THE PREPARATION OF A GRAIN STABILIZED HIGH CHLORIDE TABULAR GRAIN PHOTOGRAPHIC EMULSION (II)

[75] Inventor: Joe E. Maskasky, Rochester, N.Y.

[73] Assignee: Eastman Kodak Company, Rochester, N.Y.

[ * ] Notice: The portion of the term of this patent subsequent to Jun. 22, 2010 has been disclaimed.

[21] Appl. No.: 935,802

[22] Filed: Aug. 27, 1992

[51] Int. Cl.[5] ..... G03C 1/07; G03C 1/12

[52] U.S. Cl. ..... 430/569; 430/614; 430/615; 430/588; 430/592

[58] Field of Search ..... 430/567, 569, 614, 615, 430/588, 592

[56] References Cited

U.S. PATENT DOCUMENTS

| | | | |
|---|---|---|---|
| 2,131,038 | 9/1938 | Brooker . | |
| 4,400,463 | 8/1983 | Maskasky | 430/434 |
| 4,713,323 | 12/1987 | Maskasky | 430/569 |
| 4,783,398 | 11/1988 | Takada et al. | 430/567 |
| 4,804,621 | 2/1989 | Tufano et al. | 430/567 |
| 4,940,657 | 7/1990 | Tanaka et al. | 430/578 |
| 4,942,120 | 6/1990 | King et al. | 430/567 |
| 4,952,491 | 8/1990 | Nishikawa et al. | 430/570 |
| 4,983,508 | 1/1991 | Ishiguro et al. | 430/569 |
| 5,035,992 | 7/1991 | Houle et al. | 430/569 |
| 5,176,991 | 1/1993 | Jones et al. | 430/569 |
| 5,176,992 | 1/1993 | Maskasky et al. | 430/567 |
| 5,178,997 | 1/1993 | Maskasky | 430/569 |
| 5,178,998 | 1/1993 | Maskasky et al. | 430/569 |
| 5,183,732 | 2/1993 | Maskasky | 430/569 |
| 5,185,239 | 2/1993 | Maskasky | 430/569 |
| 5,217,858 | 6/1993 | Maskasky | 430/567 |
| 5,221,602 | 6/1993 | Makasky | 430/567 |

FOREIGN PATENT DOCUMENTS 116133 5/1991 Japan .

OTHER PUBLICATIONS

Research Disclosure vol. 308, Dec. 1989, Item 308119.

*Primary Examiner*—Charles L. Bowers, Jr.
*Assistant Examiner*—Mark F. Huff
*Attorney, Agent, or Firm*—Carl O. Thomas

[57] ABSTRACT

A process is disclosed of preparing an emulsion for photographic use comprised of silver halide grains and a gelatino-peptizer dispersing medium in which morphologically unstable tabular grains having {111} major faces account for greater than 50 percent of total grain projected area and contain at least 50 mole percent chloride, based on silver. The emulsion additionally contains at least one 2-hydroaminoazine adsorbed to and morphologically stabilizing the tabular grains. Protonation releases 2-hydroaminoazine from the tabular grain surfaces into the dispersing medium. Released 2-hydroaminoazine is replaced on the tabular grain surfaces by adsorption of a photographically useful 5-iodobenzoxazolium compound, thereby concurrently morphologically stabilizing the tabular grains and enhancing their photographic utility, and the released 2-hydroaminoazine is removed from the dispersing medium.

12 Claims, 5 Drawing Sheets

2.0 μm 2.0 μm 2.0 μm 2.0 μm 2.0μm 2.0 μm

PROCESS FOR THE PREPARATION OF A GRAIN STABILIZED HIGH CHLORIDE TABULAR GRAIN PHOTOGRAPHIC EMULSION (II)

FIELD OF THE INVENTION

The invention is directed to a process of preparing for photographic use high chloride tabular grain emulsions.

DEFINITION OF TERMS

The term "high chloride" refers to silver halide grains or emulsions in which chloride accounts for at least 50 mole percent of total halide, based on silver.

The term "2-hydroaminoazine refers to azines having a primary or secondary amino substituent that is bonded to the azine ring at a location next adjacent a ring nitrogen atom.

The term "hydroamino" is employed to designate amino groups containing at least one hydrogen substituent of the nitrogen atom—i.e., a primary or secondary amino substituent.

The term "azine" is employed to embrace six membered aromatic heterocylic rings containing carbon atoms and at least one nitrogen atom.

The term "morphological stabilization" refers to stabilizing the geometrical shape of a grain.

The term "stabilizer" is employed in its art recognized usage to designate photographic addenda that retard variances in emulsion sensitometric properties.

The term "tabular grain" is employed to designate grains having two parallel major faces lying in {111} crystallographic planes.

The terms "monolayer coverage" and "monomolecular layer" are employed in their art recognized usage to designate the calculated concentration of an adsorbed species that, if uniformly distributed on emulsion grain surfaces, would provide a layer of one molecule thickness.

The term "photographically useful compound" refers to compounds (i.e., addenda) that function during the storage, exposure and/or processing of photographic elements to enhance their image forming properties.

BACKGROUND OF THE INVENTION

Radiation sensitive silver halide emulsions containing one or a combination of chloride, bromide and iodide ions have been long recognized to be useful in photography. Each halide ion selection is known to impart particular photographic advantages. By a wide margin the most commonly employed photographic emulsions are silver bromide and bromoiodide emulsions. Although known and used for many years for selected photographic applications, the more rapid developability and the ecological advantages of high chloride emulsions have provided an impetus for employing these emulsions over a broader range of photographic applications.

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multiemulsion layer formats, can be realized by increasing the proportions of selected tabular grain populations in photographic emulsions.

In almost every instance tabular grain emulsions have been formed by introducing two or more parallel twin planes into octahedral grains during their preparation. Regular octahedral grains are bounded by {111} crystal faces. The predominant feature of tabular grains formed by twinning are opposed parallel {111} major crystal faces. The major crystal faces have a three fold symmetry, typically appearing triangular or hexagonal.

The formation of tabular grain emulsions containing parallel twin planes is most easily accomplished in the preparation of silver bromide emulsions. The art has developed the capability of including photographically useful levels of iodide. The inclusion of high levels of chloride as opposed to bromide, alone or in combination with iodide, has been difficult. Silver chloride differs from silver bromide in exhibiting a much stronger propensity toward the formation of grains with faces lying in {100} crystalographic planes. To produce successfully a high chloride tabular grain emulsion by twinning, conditions must be found that favor both the formation of twin planes and {111} crystal faces. Further, after the emulsion has been formed, tabular grain morphological stabilization is required to avoid reversion of the grains to their favored more stable form exhibiting {100} crystal faces. When high chloride tabular grains having {111} major faces undergo morphological reversion to forms presenting {100} grain faces the tabular character of the grains is either significantly degraded or entirely destroyed and this results in the loss of the photographic advantages known to be provided by tabular grains.

Maskasky U.S. Pat. No. 4,400,463 (hereinafter designated Maskasky I) was the first to prepare in the presence of a 2-hydroaminoazine a high chloride emulsion containing tabular grains with parallel twin planes and {111} major crystal faces. The strategy was to use a particularly selected synthetic polymeric peptizer in combination with an adsorbed aminoazaindene, preferably adenine, acting as a grain growth modifier.

Maskasky U.S. Pat. No. 4,713,323 (hereinafter designated Maskasky II), significantly advanced the state of the art by preparing high chloride emulsions containing tabular grains with parallel twin planes and {111} major crystal faces using an aminoazaindene grain growth modifier and a gelatino-peptizer containing up to 30 micromoles per gram of methionine. Since the methionine content of a gelatino-peptizer, if objectionably high, can be readily reduced by treatment with a strong oxidizing agent (or alkylating agent, King et al U.S. Pat. No. 4,942,120), Maskasky II placed within reach of the art high chloride tabular grain emulsions with significant bromide and iodide ion inclusions prepared starting with conventional and universally available peptizers.

Maskasky I and II have stimulated further investigations of grain growth modifiers capable of preparing high chloride emulsions of similar tabular grain content. As grain growth modifiers, Tufano et al U.S. Pat. No. 4,804,621 employed 4,6-di(hydroamino)-pyrimidines lacking a 5-position amino substituent (a 2-hydroaminoazine species); Japanese patent application 03/116,133, published May 17, 1991, employed adenine (a 2-hydroaminoazine species) in the pH range of from 4.5 to 8.5; Takada et al U.S. Pat. No. 4,783,398 employed heterocycles containing a divalent sulfur ring atom; Nishikawa et al U.S. Pat. No. 4,952,491 employed spectral sensitizing dyes and divalent sulfur atom containing heterocycles and acyclic compounds; and Ishiguro et al U.S. Pat. No. 4,983,508 employed organic bis-quaternary amine salts.

In the foregoing patents there is little or no mention of stabilizing the tabular grain shape in the high chloride emulsions, since the continued presence of conditions favorable for stabilizing the {111} major faces of the tabular grains, usually the presence of a 2-hydroaminoazine, is assumed. Houle et al U.S. Pat. No. 5,035,992 specifically addresses the problem of stabilizing high chloride tabular grain emulsions prepared in the presence of a 2-hydroaminoazine (specifically 4,6-di(hydroamino)-pyrimidines lacking a 5-position amino substituent). Houle et al accomplished stabilization during tabular grain precipitation by continuously increasing the ratio of bromide to chloride being precipitated until the tabular grains were provided with stabilizing silver bromide shells. The Houle et al process is, of course, incompatible with producing a pure chloride emulsion, since at least some silver bromide must be included, and the process also has the disadvantage that the pyrimidine is left on the grain surfaces. Additionally, as shown in the Examples below, the grains remain morphologically unstable when their pH is lowered to remove the pyrimidine.

The emulsion teachings noted above either explicitly or implicitly suggest utilization of the emulsions with conventional grain adsorbed and unadsorbed addenda. A relatively recent summary of conventional photographic emulsion addenda is contained in *Research Disclosure* Vol. 308, December 1989, Item 308119. *Research Disclosure* is published by Kenneth Mason Publications, Ltd., Emsworth, Hampshire P010 7DD, England. While a wide variety of emulsion addenda can be adsorbed to grain surfaces, spectral sensitizing dyes and desensitizers (*Res.Dis.* Section IV) and antifoggants and stabilizers (*Res.Dis.* Section VI) are examples of photographically useful addenda that are almost always adsorbed to grain surfaces.

Brooker U.S. Pat. No. 2,131,038 discloses benzoxazolium salts to be useful antifogging agents. Tanaka et al U.S. Pat. No. 4,940,657 discloses spectral sensitizing dyes containing at least one 5-iodobenzoxazolium nucleus.

Related Patent Applications

Maskasky U.S. Ser. No. 762,971, filed Sep. 20, 1991, commonly assigned, titled IMPROVED PROCESS FOR THE PREPARATION OF HIGH CHLORIDE TABULAR GRAIN EMULSIONS (II), now U.S. Pat. No. 5,178,997, (hereinafter designated Maskasky III) discloses a process for preparing a high chloride tabular grain emulsion in which silver ion is introduced into a gelatino-peptizer dispersing medium containing a stoichiometric excess of chloride ions of less than 0.5 molar and a 2-hydroaminoazine grain growth modifier of the formula:

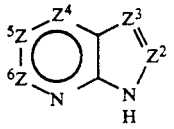

where $Z^2$ is $—C(R^2)=$ or $—N=$;

$Z^3$ is $—C(R^3)=$ or $—N=$;

$Z^4$ is $—C(R^4)=$ or $—N=$;

$Z^5$ is $—C(R^5)=$ or $—N=$;

$Z^6$ is $—C(R^6)=$ or $—N=$;

with the proviso that no more than one of $Z^4$, $Z^5$ and $Z^6$ is $—N=$;

$R^2$ is H, $NH_2$ or $CH_3$;

$R^3$, $R^4$ and $R^5$ are independently selected, $R^3$ and $R^5$ being hydrogen, halogen, amino or hydrocarbon and $R^4$ being hydrogen, halogen or hydrocarbon, each hydrocarbon moiety containing from 1 to 7 carbon atoms; and $R^6$ is H or $NH_2$.

Maskasky U.S. Ser. No. 819,712, filed Jan. 13, 1992 (as a continuation-in-art of U.S. Ser. No. 763,382, filed Sep. 20, 1991) and commonly assigned, titled IMPROVED PROCESS FOR THE PREPARATION OF HIGH CHLORIDE TABULAR GRAIN EMULSIONS (IV), now U.S. Pat. No. 5,185,239, (hereinafter designated Maskasky IV) discloses a process for preparing a high chloride tabular grain emulsion in which silver ion is introduced into a gelatino-peptizer dispersing medium containing a stoichiometric excess of chloride ions of less than 0.5 molar, a pH of at least 4.6, and a triaminopyrimidine grain growth modifier containing mutually independent 4, 5 and 6 ring position amino substituents with the 4 and 6 ring position substituents being hydroamino substituents. This grain growth modifier is a 2-hydroaminoazine species.

Maskasky U.S. Ser. No. 820,168, filed Jan. 12, 1992 (as a continuation-in-art of U.S. Ser. No. 763,382, filed Sep. 20, 1991) and commonly assigned, titled IMPROVED PROCESS FOR THE PREPARATION OF HIGH CHLORIDE TABULAR GRAIN EMULSIONS (V), now U.S. Pat. No. 5,183,732, (hereinafter designated Maskasky V) discloses a process for preparing a high chloride tabular grain emulsion in which silver ion is introduced into a gelatino-peptizer dispersing medium containing a stoichiometric excess of chloride ions of less than 0.5 molar, a pH of at least 4.6, and a 2-hydroaminoazine grain growth modifier of the formula

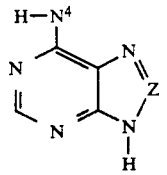

where $N^4$ is an amino moiety and

Z represents the atoms completing a 5 or 6 member ring.

Maskasky and Chang U.S. Ser. No. 763,013, filed Sep. 20, 1991, commonly assigned, titled IMPROVED PROCESS FOR THE PREPARATION OF HIGH CHLORIDE TABULAR GRAIN EMULSIONS (III), now U.S. Pat. No. 5,178,998 (hereinafter designated Maskasky et al I) discloses a process for preparing a high chloride tabular grain emulsion in which silver ion is introduced into a gelatino-peptizer dispersing medium containing a stoichiometric excess of chloride ions of less than 0.5 molar and a grain growth modifier of the formula:

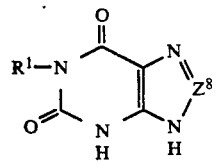

where $Z^8$ is —C($R^8$)= or —N=;

$R^8$ is H, $NH_2$ or $CH_3$; and $R^1$ is hydrogen or a hydrocarbon containing from 1 to 7 carbon atoms.

The grain growth modifier is not a 2-hydroaminoazine.

Maskasky and Chang U.S. Ser. No. 820,181, filed Jan. 13, 1992 now U.S. Pat. No. 5,176,992 (hereinafter referred to as Maskasky et al II) and commonly assigned, titled PROCESS FOR THE PREPARATION OF A GRAIN STABILIZED HIGH CHLORIDE TABULAR GRAIN PHOTOGRAPHIC EMULSION (II), discloses a process of preparing an emulsion for photographic use comprising (a) forming an emulsion as taught by Maskasky et al I, above, (b) reducing the pH of the dispersing medium below 4.0 to inactivate the xanthinoid as a morphological stabilizer, and (c) replacing the inactivated xanthinoid on the tabular grain surfaces by adsorption of the photographically useful compound, the photographically useful compound being selected from among those containing at least one divalent sulfur atom, thereby concurrently morphologically stabilizing the tabular grains and enhancing their photographic utility.

Maskasky U.S. Ser. No. 820,182, filed Jan. 13, 1992 (as a continuation-in-art of U.S. Ser. No. 763,030, filed Sep. 20, 1991, now U.S. Pat. No. 5,217,858) and commonly assigned, titled PROCESS FOR THE PREPARATION OF A GRAIN STABILIZED HIGH CHLORIDE TABULAR GRAIN EMULSION (I), now U.S. Pat. No. 5,221,602, (hereinafter designated Maskasky VI) discloses a process for preparing a high chloride tabular grain emulsion in which morphologically unstable tabular grains having {111} major faces account for greater than 50 percent of total grain projected area and contain at least 50 mole percent chloride, based on silver. The emulsion additionally contains at least one 2-hydroaminoazine adsorbed to and morphologically stabilizing the tabular grains. Protonation releases 2-hydroaminoazine from the tabular grain surfaces. Released 2-hydroaminoazine is replaced on the tabular grain surfaces by adsorption of a photographically useful compound selected from among those that contain at least one divalent sulfur atom, thereby concurrently morphologically stabilizing the tabular grains and enhancing their photographic utility, and the released 2-hydroaminoazine is removed from the emulsion.

Maskasky U.S. Ser. No. 935,806, filed concurrently herewith and commonly assigned, titled PROCESS FOR THE PREPARATION OF A GRAIN STABILIZED HIGH CHLORIDE TABULAR GRAIN EMULSION (III), (hereinafter designated Maskasky VII) discloses a process essentially similar to that of Maskasky VI, except that a cationic or zwitterionic benzimidazolium dye is substituted for the compound containing a divalent sulfur atom.

SUMMARY OF THE INVENTION

In one aspect this invention is directed to a process preparing an emulsion for photographic use comprising (1) forming an emulsion comprised of silver halide grains and a gelatino peptizer dispersing medium in which morphologically unstable tabular grains having {111} major faces account for greater than 50 percent of total grain projected area and contain at least 50 mole percent chloride, based on silver, the emulsion additionally containing at least one 2-hydroaminoazine adsorbed to and morphologically stabilizing the tabular grains, and (2) adsorbing to surfaces of the tabular grains a photographically useful compound:

Wherein (a) 2-hydroaminoazine adsorbed to the tabular grain surfaces is protonated and thereby released from the tabular grain surfaces into the dispersing medium, (b) the released 2-hydroaminoazine is replaced on the tabular grain surfaces by adsorption of a photographically useful 5-iodobenzoxazolium compound, thereby concurrently morphologically stabilizing the tabular grains and enhancing their photographic utility, and (c) released 2-hydroaminoazine is removed from the dispersing medium.

The present invention offers a combination of advantages. From a review of the various citations above it is apparent that the majority of emulsion preparations rely on one species or another of 2-hydroaminoazine, typically adenine or a 4,6-diaminopyrimidine lacking a 5-position amino substituent, as a grain growth modifier to produce high chloride tabular grains having {111} major grain faces. Despite the efficacy of these grain growth modifiers to produce and maintain the desired tabular grain morphologies, at a minimum they represent an additional emulsion ingredient, thereby adding to the complexity of photographic emulsions that often contain many ingredients and adding to the complexity of photographic elements that can contain many different layers, often including multiple emulsion layers of varying composition and photographic performance characteristics. To the extent that the grain growth modifiers remain adsorbed to the tabular grains they compete with other adsorbed photographic addenda for grain surface sites. To the extent that the grain growth modifiers equilibrate with the surrounding emulsion dispersing medium they can affect other photographic element layers and solutions used for processing.

In the practice of the present invention at least a portion of the adsorbed 2-hydroaminoazine grain growth modifier is released from the high chloride tabular grain surfaces and replaced by one or more photographically useful adsorbed photographic addenda capable of preventing the morphologically unstable tabular grains with {111} major faces from reverting to less photographically desirable morphological grain forms. It has been observed that this function can be performed by employing one or more photographically useful compounds selected to contain at least one 5-iodobenzoxazolium nucleus. Fortunately, a wide variety of photographically useful compounds are known containing at least one benzoxazolium nucleus. By modifying any of these compounds to include a 5-iodo substituent, demonstrated in the Examples below to be essential to morphological stabilization, they are useful both to replace the adsorbed 2-hydroaminoazine and to perform a separate useful photographic function. Thus, replacement of adsorbed 2-hydroaminoazine with a 5-iodobenzoxazolium compound allows the complexity of the emulsion to be reduced and increases the grain surface area available to be occupied by compounds that both morphologically stabilize the tabular grains and perform photographically useful functions.

A further distinct advantage of the present invention is that released 2-hydroaminoazine grain growth modifier is removed from the emulsion. This can be used to minimize or eliminate entirely subsequent interaction of the grain growth modifier with other portions of the photographic element in which the emulsion is incorporated (e.g., other emulsion layers) as well as eliminating any possibility of accumulating the grain growth modifier in processing solutions (particularly acidic solutions). Still further, the released and removed 2-hydroaminoazine can be reclaimed, thereby minimizing waste and allowing reuse of the grain growth modifier in preparing subsequent emulsions.

DESCRIPTION OF PREFERRED EMBODIMENTS

Figure 1:
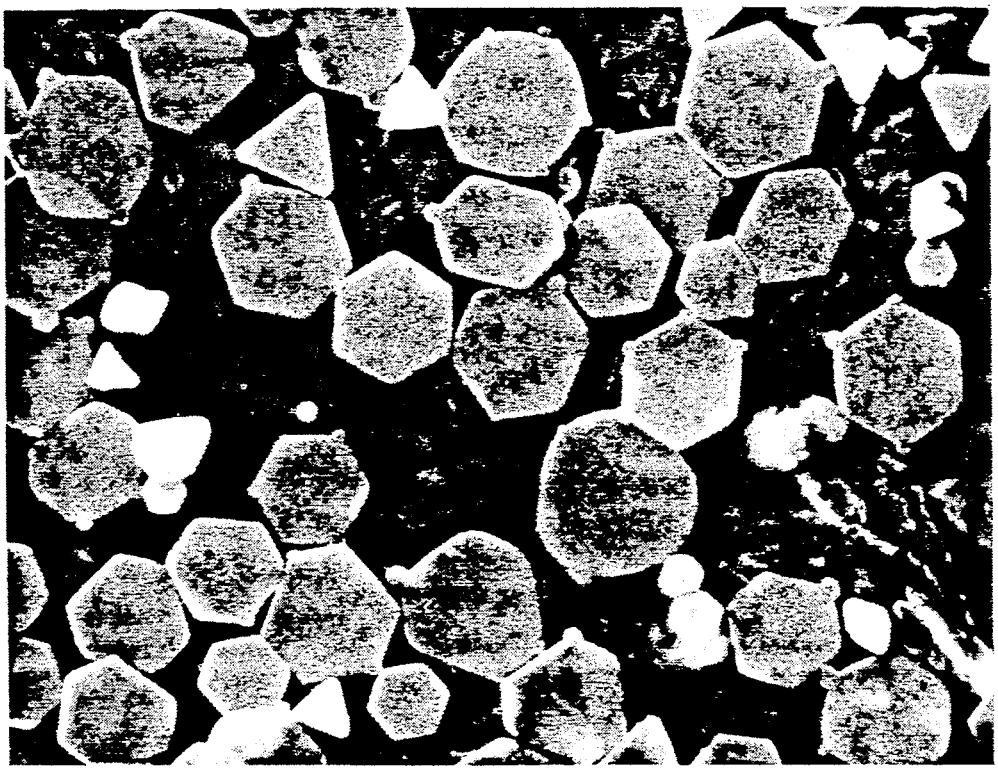
FIG. 1—Scanning electron photomicrograph viewed perpendicular to the support of Example Emulsion 2c.

The present invention is directed to a process of improving for photographic use the properties of a high chloride tabular grain emulsion in which the tabular grains have major faces lying in {111}crystallographic planes and rely on a 2-hydroaminoazine adsorbed to surfaces of the tabular grains for morphological stabilization. Emulsions of this type are illustrated by Maskasky U.S. Pat. No. 4,713,323, King et al U.S. Pat. No. 4,942,120, Tufano et al U.S. Pat. No. 4,804,621, Japanese patent application 03/116,133, published May 17, 1991, and Houle et al U.S. Pat. No. 5,035,992, the disclosures of which are here incorporated by reference.

The emulsions contain in addition to the grains and adsorbed 2-hydroaminoazine a conventional dispersing medium for the grains. The dispersing medium is invariably an aqueous medium and in the overwhelming majority of applications contains a gelatino-peptizer. In the practice of the invention the pH of the dispersing medium is lowered until the 2-hydroaminoazine adsorbed to the tabular grain surfaces is protonated. This transforms the 2-hydroamino moiety into a cationic moiety having a diminished adsorption capability and also renders the protonated 2-hydroaminoazine soluble in the aqueous (and hence polar) dispersing medium.

To protect the tabular grains from morphological degradation to less tabular grain shapes the released 2-hydroaminoazine is replaced on the tabular grain surfaces with any one or combination of known photographically useful addenda containing at least one 2-iodobenzoxazolium nucleus to promote adsorption to grain surfaces. By selecting photographically useful addenda of this type for incorporation, the morphological stabilization function performed by the 2-hydroaminoazine prior to protonation and release is performed while the known photographic utility of the replacement adsorbed compound is also realized. In other words the replacement adsorbed compounds is now performing at least two distinct functions.

After the replacement compound has been adsorbed to the tabular grain surfaces, the released protonated 2-hydroaminoazine can be removed from the dispersing medium using any convenient conventional technique for removing emulsion solutes, such as coagulation washing, ultrafiltration and the like. Illustrative procedures of this type are summarized in *Research Disclosure* Item 308119, cited above, Section II, the disclosure of which is here incorporated by reference. The 2-hydroaminoazine removed from the emulsion can be reclaimed and reused, if desired. If discarded, the 2-hydroaminoazines can be selected for minimal cost and ecological impact. Adenine (Vitamin B4) is a specific example of a low cost, ecologically benign 2-hydroaminoazine.

Preferred high chloride tabular grain emulsions for use in the practice of the invention contain tabular grains accounting for at least 50 percent of total grain projected area that contain at least 50 mole percent chloride, based on total silver. The tabular grains preferably contain less than 5 mole percent iodide. Bromide can account for the balance of the halide. In other words, the invention is applicable to emulsions in which the high chloride tabular grains are silver chloride, silver iodochloride, silver bromochloride, silver bromoiodochloride and/or silver iodobromochloride tabular grains. The chloride content of the tabular grains is preferably at least 80 mole percent and optimally at least 90 mole percent, based on total silver while the iodide content is preferably less than 2 mole percent and optimally less than 1 mole percent. When more than one halide ion is present in the tabular grains, the halides can be uniformly or nonuniformly distributed. For example, the invention is applicable to emulsions of the type disclosed by Houle et al, cited and incorporated by reference above.

The photographic advantages of tabular grains are a function of their tabularity. Preferred emulsions in which the tabular grains exhibit a high mean tabularity—that is, they satisfy the mean tabularity relationship:

$$\frac{ECD}{t^2} > 25$$

where

ECD is the mean effective circular diameter of the high chloride tabular grains in μm and t is the mean thickness of the high chloride tabular grains in μm.

In terms of mean aspect ratios the high chloride tabular grains preferably exhibit high aspect ratios—that is, $ECD/t > 8$. When high aspect ratio tabular grains exhibit a thickness of 0.3 μm or less, the grains also exhibit high tabularity. When the thickness of the tabular grains is 0.2 μm or less, high tabularities can be realized at intermediate aspect ratios of 5 or more.

Maximum mean tabularities and mean aspect ratios are a function of the mean ECD of the high chloride tabular grains and their mean thickness. The mean ECD of the high chloride tabular grains can range up to the limits of photographic utility (that is, up to about 10 μm), but are typically 4 μm or less. Tufano et al, cited and incorporated by reference above, discloses high chloride tabular grain emulsions satisfying the requirements of this invention having thicknesses ranging down to 0.062 μm (388 {111} crystal lattice planes). In. U.S. Ser. No. 763,030, filed Sep. 20, 1991, now U.S. Pat. No. 5,217,858 cited above and here incorporated by reference, ultrathin tabular grain emulsions are disclosed in which high chloride tabular grains have mean thicknesses of less than 360 {111} lattice planes. Using a silver chloride {111} lattice spacing of 1.6 Å as a reference, the following correlation of grain thicknesses in μm applies:

360 lattices planes<0.06 μm
300 lattices planes<0.05 μm
180 lattices planes<0.03 μm
120 lattices planes<0.02 μm Ultrathin high chloride tabular grain emulsions in which mean grain thicknesses range down to 120 lattice planes can be prepared.

It is specifically contemplated to apply the practice of the present invention to thin (t<0.2 μm) and ultrathin (t<360 {111} lattice planes) tabular grains, since the morphological instability of the tabular grains increases as their mean thickness decreases.

To maximize the advantages of having high chloride tabular grains present in the emulsions it is preferred that the high chloride tabular grains account for greater than 70 percent and, optimally, greater than 90 percent of total grain projected area. With care in preparation or when accompanied by conventional grain separation techniques the projected area accounted for by high chloride tabular grains can approximate 100 percent of total grain projected area for all practical purposes.

Grains other than the high chloride tabular grains when present in the emulsion are generally coprecipitated grains of the same halide composition. It is recognized that for a variety of applications the blending of emulsions is undertaken to achieve specific photographic objectives. When the photographically useful compound intended to replace the released protonated 2-hydroaminoazine can be usefully adsorbed to the grains of all component emulsions, the protonation and subsequent process steps can usefully occur after blending. It is therefore apparent that the grains of the emulsion other than the high chloride tabular grains can take any of a wide variety of forms in halide content, size and crystallographic shape. It is generally advantageous to release the 2-hydroaminoazine from the grain surfaces after precipitation and before washing, thereby avoiding a second washing step for removal of protonated 2-hydroaminoazine. When the photographically useful compound intended to replace the released protonated 2-hydroaminoazine is intended to be adsorbed only to the high chloride grain surfaces, the process of the present invention is, of course, practiced before blending.

The essential structural components of the 2-hydroaminoazine can be visualized from the following formula:

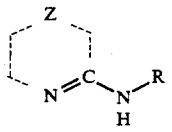

(I)

where

Z represents the atoms completing a 6 member aromatic heterocyclic ring the ring atoms of which are either carbon or nitrogen and R represents hydrogen, any convenient conventional monovalent amino substituent group (e.g., a hydrocarbon or halohydrocarbon group), or a group that forms a five or six membered heterocyclic ring fused with the azine ring completed by Z.

The structural features in formula I that morphologically stabilize the tabular grain {111} crystal faces are (1) the spatial relationship of the two nitrogen atoms shown, (2) the aromatic ring stabilization of the left nitrogen atom, and (3) the hydrogen attached to the right nitrogen atom. It is believed that the two nitrogen atoms interact with the {111} crystal face to facilitate adsorption. The atoms forming R and Z can, but need not, be chosen to actively influence adsorption and morphological stabilization. Various forms of Z and R are illustrated by various species of 2-hydroaminoazines described below.

In one illustrative form the 2-hydroaminoazine can satisfy the formula:

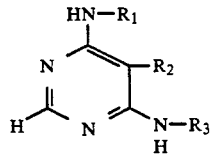

(II)

wherein $R_1$, $R_2$ and $R_3$, which may be the same or different, are H or alkyl of 1 to 5 carbon atoms; $R_2$ and $R_3$ when taken together can be $—CR_4=CR_5—$ or $—CR_4=N—$, wherein $R_4$ and $R_5$, which may be the same or different are H or alkyl of 1 to 5 carbon atoms, with the proviso that when $R_2$ and $R_3$ taken together form the $—CR_4=N—$, linkage, $—CR_4=$ must be joined to the ring at the $R_2$ bonding position.

In another illustrative form the 2-hydroaminoazine can satisfy the following formula:

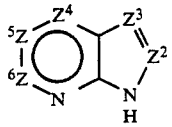

(III)

where $Z^2$ is $—C(R^2)=$ or $—N=$;
$Z^3$ is $—C(R^3)=$ or $—N=$;
$Z^4$ is $—C(R^4)=$ or $—N=$;
$Z^5$ is $—C(R^5)=$ or $—N=$;
$Z^6$ is $—C(R^6)=$ or $—N=$;
with the proviso that no more than one of $Z^4$, $Z^5$ and $Z^6$ is $—N=$;
$R^2$ is H, $NH_2$ or $CH_3$;
$R^3$, $R^4$ and $R^5$ are independently selected, $R^3$ and $R^5$ being hydrogen, hydrogen, halogen, amino or hydrocarbon and $R^4$ being hydrogen, halogen or hydrocarbon, each hydrocarbon moiety containing from 1 to 7 carbon atoms; and
$R^6$ is H or $NH_2$.

In an additional illustrative form the 2-hydroaminoazine can take the form of a triamino-pyrimidine grain growth modifier containing mutually independent 4, 5 and 6 ring position amino substituents with the 4 and 6 ring position substituents being hydroamino substituents. The 2-hydroaminoazine in this form can satisfy the formula:

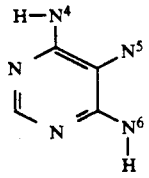

(IV)

where $N^4$, $N^5$ and $N^6$ are independent amino moieties. In a specifically preferred form the 2-hydroaminoazines satisfying formula IV satisfy the following formula:

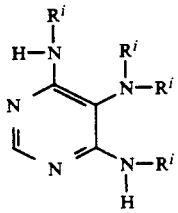

(V)

where $R^i$ is independently in each occurrence hydrogen or alkyl of from 1 to 7 carbon atoms.

In still another illustrative form the 2-hydroaminoazine can satisfy the formula:

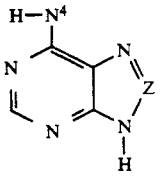

(VI)

where $N^4$ is an amino moiety and

Z represents the atoms completing a 5 or 6 member ring.

The high chloride tabular grain emulsions as initially prepared can contain any concentration of 2-hydroaminoazine capable of morphologically stabilizing the tabular grains. Adequate morphological stabilization of the tabular grains is realized when the 2-hydroaminoazine is present in the emulsion in a concentration of at least 25 percent of monolayer coverage. Maximum protection of the tabular grains is theoretically realized when sufficient 2-hydroaminoazine is present to provide complete (100 percent) monolayer coverage, although in practice maximum attainable morphological stabilization is observed at concentrations of 75 percent of monolayer coverage or less. Inclusions of excess 2-hydroaminoazine beyond that which can be adsorbed to grain surfaces can be accommodated, the excess unadsorbed 2-hydroaminoazine is readily removed by washing.

Protonation of the 2-hydroaminoazine adsorbed to the high chloride tabular grain surfaces to effect release into the dispersing medium can be achieved merely by lowering the pH of emulsion. pH is preferably lowered using the same mineral acids (e.g., sulfuric acid or nitric acid) conventionally used to adjust pH during emulsion precipitation. While each 2-hydroaminoazine is protonated at a slightly different pH, protonation of preferred compounds can be effected within the pH range of from 5.0 to 1.0, most preferably from 4.0 to 1.5. Protonation in these ranges is highly advantageous, since it allows the common pH ranges of emulsion precipitation to be employed and allows protonation to be achieved without subjecting the emulsions to extremely acidic conditions that could degrade other components.

Photographically useful compounds containing at least one 5-iodobenzoxazolium nucleus (prepared merely by modifying the synthesis of corresponding known benzoxazolium compounds lacking a 5 position iodo substituent) are employed to replace the protonated and released 2-hydroaminoazine as a morphological stabilizer on the tabular grain surfaces. A wide variety of conventional photographically useful emulsion addenda containing benzoxazolium nuclei are available to choose among. Spectral sensitizing dyes, desensitizers, hole trapping dyes, antifoggants, stabilizers and development modifiers are illustrations of different classes of photographically useful compounds that are known to contain at least one benzoxazolium nucleus and can be selected (or synthetically modified) to contain a 5-iodo substitutent of one or more benzoxazolium moieties.

For example, Brooker U.S. Pat. No. 2,131,038, the disclosure of which is here incorporated by reference, discloses the utility of benzoxazolium salts as antifogging agents. Tanaka et al U.S. Pat. No. 4,940,657, the disclosure of which is here incorporated by reference, discloses 5-iodo substituted variations of the benzoxazolium salts disclosed by Brooker et al that exhibit both the photographically useful function (antifogging) and morphological stabilization capabilities required for the practice of this invention.

Tanaka et al also discloses spectral sensitizing dyes containing 5-iodobenzoxazolium nuclei. These spectral sensitizing dyes can be used to perform both a spectral sensitization and morphological stabilization function in the practice of this invention.

Further, the 5-iodobenzoxazolium salts employed by Tanaka et al as starting materials for spectral sensitizing dye synthesis can alternatively be employed as starting materials for the synthesis of other spectral sensitizing dyes, hole acceptors and/or desensitizers merely by replacing a conventional benzazolium salt starting material with a corresponding 5-iodobenzoxazolium salt. For example, Gunther et al U.S. Pat. No. 4,576,905, the disclosure of which is here incorporated by reference, discloses the preparation of a wide variety of polymethine dyes by reacting a 2-methylbenzotellurazolium nucleus in a conventional dye synthesis reaction. Dyes useful in the practice of this invention can be prepared merely by substituting any one of the 5-iodo-2-methylbenzoxazolium starting materials of Tanaka et al for any one of the 2-methylbenzotellurazolium starting materials in the syntheses of Gunther et al.

In a simple form the 5-iodobenzoxazolium nucleus can take the following form: (VII)

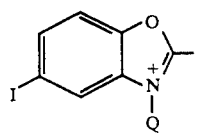

(VII)

wherein

Q represents a quaternizing substituent.

The quaternizing substituent can take any synthetically convenient form. The quaternizing substituent can take the form of any conventional quaternizing substituent of a basic nucleus of a cyanine dye. Typically the quaternizing substituent is a hydrocarbon or substituted hydrocarbon. The quaternizing substituent preferably contains from 1 to 12 carbon atoms and optimally from 1 to 6 carbon atoms. Examples of hydrocarbon substituents are methyl, ethyl, n-propyl, iso-butyl, iso-pentyl, cyclohexyl, phenyl and phenethyl. Since the dispersing media of silver halide emulsions are hydrophilic, it is often preferred to increase the hydrophilicity of the benzoxazolium nucleus by providing a substituted hydrocarbon quaternizing substituent that includes a polar or ionizable group. Common solubilizing groups include carboxy, sulfo and sulfato groups. Examples of preferred quaternizing substituents containing such solubilizing groups include carboxyalkyl, sulfoalkyl and sulfatoalkyl groups, where the alkyl groups contain from 1 to 6 carbon atoms in the alkyl moiety (e.g., methyl, ethyl, propyl, butyl, etc.); carboxyaryl, sulfoaryl and sulfatoaryl, where the aryl moiety contains from 6 to 10 carbon atoms (e.g., phenyl, naphthyl, etc.); and similarly substituted aralkyl (e.g., phenylethyl, 2-phenylpropyl, etc.) and alkaryl groups (e.g., tolyl, xylyl, etc.). Other common substituents of hydrocarbon moieties employed as quaternizing groups are halogen (F, Br, Cl or I), aryloxy and alkyoxy groups. Although the quaternizing substituent is shown attached to the benzoxazolium nucleus only at the 3 ring position, it is recognized that the quaternizing substituent can be conveniently attached to the benzoxazolium nucleus at both the 3 and 4 ring positions—i.e., the quaternizing substituent can complete a fused 5 or 6 member ring. For example, Hamer, *The Cyanine Dyes and Related Compounds,* John Wiley & Sons, 1964, at page 308 discloses a 2-methylbenzoxazolium compound with a 1,3-propanediyl quaternizing substituent bridging the 3 and 4 ring positions, thereby completing a fused 6 member ring.

In formula (VII) above no substituents are shown in the 4, 6 and 7 ring positions. The 7 ring position is preferably free of substitution or limited to a substituent of minimum bulk, such as a fluoro atom. Any synthetically convenient substituent is contemplated for the 4 and 6 ring positions.

The 6 ring position offers a particularly convenient substitution site. In a more general preferred form the 5-iodobenzoxazolium nucleus can take the following form:

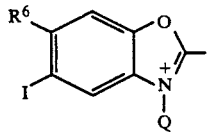

(VIII)

wherein

Q is a quaternizing substituent, as previously defined;

$R^6$ is hydrogen, halogen or $Q'—(X)_n—$;

Q' is hydrogen or a substituted or unsubstituted hydrocarbon of from 1 to 12, preferably 1 to 6, carbon atoms;

X is a divalent oxygen or sulfur atom; and n is the integer zero or 1.

The halogen can be F, Cl, Br or I. Q' can take any of the various forms of substituted or unsubstituted hydrocarbons described above in connection with the quaternizing substituent. When n is 1, the $R^6$ substituent is an oxy or thia substituent—e.g., a hydroxy, alkoxy, aryloxy, mercapto, alkylthio or arylthio substituent.

In the simplest contemplated form of the invention the 5-iodobenzoxazolium nucleus is unsubstituted in the 2 position. That is, in formulae VII and VIII a complete compound consists of formula atoms plus hydrogen attached to the unsatisfied bond at the 2 ring position. A counter ion of any convenient type may also be present if required to provide charge neutrality. For example, if Q and $R^6$ are both charge neutral substituents an anion can be chosen of any suitable type, such as halogen, perchlorate, trifluoromethane-sulfonate, p-toluenesulfonate, tetrafluoroborate, etc. If either Q or $R^6$ is an anionic substituent, the 5-iodobenzoxazolium compound is a charge neutral zwitterionic compound and no counter ion is required. If the 5-iodobenzoxazolium compound contains more than one anionic substituent, a charge balancing cation, such as an alkali metal ion (e.g., $Na^+$, $K^+$ or $Li^+$) or an ammonium counter ion (e.g., triethylamine), completes the 5-iodobenzoxazolium compound.

Thus a simple 5-iodobenzoxazolium compound useful in the practice of the invention can satisfy the formula:

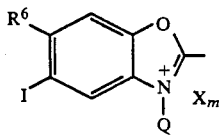

(IX)

where $R^6$ and Q are as previously defined;

X is a charge balancing counter ion; and m is the integer zero or 1.

Since it is synthetically convenient to provide a substituent at the 2 position of the benzoxazolium nucleus, in preferred forms of the invention a more general class of 5-iodobenzoxazolium compounds are contemplated satisfying the formula:

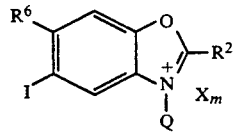

(X)

where $R^6$, Q, X and m can take any form previously described and $R^2$ is hydrogen or any synthetically convenient substituent.

In a simple preferred form $R^2$ is hydrogen or can take any of the various forms described above in connection with $R^6$.

When the photographic utility (in addition to morphological stabilization of the high chloride tabular grains) that the 5-iodobenzoxazolium compound is intended to perform is to function as a photographically useful dye, it is specifically contemplated to choose $R^2$ to complete a dye chromophore.

In a specifically preferred form of the invention $R^2$ represents the atoms completing a polymethine dye. The polymethine dyes contemplated include cyanines, merocyanines, complex cyanines and merocyanines (i.e., tri-, tetra- and polynuclear cyanines and merocyanines), hemioxonols and streptocyanines. Polymethine dyes are well known to be useful as spectral sensitizing dyes, often concurrently functioning as hole trapping dyes, and, for specialized applications, as electron trapping dyes.

In a specifically preferred form of the invention the 5-iodobenzoxazolium compounds employed as morphological stabilizers for the high chloride tabular grains are cyanine spectral sensitizing dyes. The cyanine spectral sensitizing dyes can take the form of any conventional cyanine dye containing at least one nucleus having or synthetically modified to have a 5-iodo substituent. In specifically preferred forms of the invention the cyanine dye is a monomethine cyanine, carbocyanine or dicarbocyanine. Although longer chromophore cyanine dyes are specifically contemplated, particularly where sensitization in the near infrared portion of the spectrum is contemplated, photographic applications requiring spectral sensitization within the visible portion of the spectrum account for the overwhelming majority of cyanine dye uses.

Preferred cyanine dyes satisfying the requirements of the invention are those that satisfy the formula:

$$\begin{array}{c} \text{5IBOX}-L^1=(L^2-L^3=)_pN_B \\ \Updownarrow \\ \text{5IBOX}=L^1-(L^2=L^3-)_pN_B \end{array} \qquad \text{(XI)}$$

where

5IBOX is any 5-iodobenzoxazolium nucleus previously described;

$L^1$, $L^2$ and $L^3$ are methine (—CR=) groups;

R is hydrogen or a hydrocarbon of from 1 to 6 carbon atoms, optimally alkyl of from 1 to 3 carbon atoms;

p is the integer zero, 1 or 2; and $N_B$ is a basic heterocyclic nucleus of the type found in cyanine dyes.

Basic heterocyclic nuclei typically include those derived from quinolinium, pyridinium, isoquinoinium, 3H-indolium, benz[e]indolium, oxazolium, thiazolium, selenazolium, imidazolium, benzoxazolium, benzothiazolium, benzoselenazolium, benzimidazolium, naphthooxazolium, naphthothiazolum, naphthoselenazolium, thiazolinium, dihydronaphthothiazolium, pyrylium and imidazopyrazinium quaternary salts. The basic heterocyclic nuclei can also include benzo- and naphthotellurazoles and oxatellurazoles, such as those described by Gunther et al U.S. Pat. Nos. 4,575,483, 4,576,905 and 4,599,410, the disclosures of which are here incorporated by reference.

In one specifically preferred class of cyanine dyes useful in the practice of the invention two 5-iodobenzoxazolium nuclei are present. For example, the dyes satisfy the formula:

$$\begin{array}{c} \text{5IBOX}-L^1=(L^2-L^3=)_p\text{5IBOX} \\ \Updownarrow \\ \text{5IBOX}=L^1-(L^2=L^3-)_p\text{5IBOX} \end{array} \qquad \text{(XII)}$$

where

5IBOX, $L^1$, $L^2$, $L^3$ and p are as previously described.

In a specifically preferred form of the invention the cyanine dyes are chosen from among those that exhibit J aggregration when adsorbed to the surfaces of the tabular high chloride grains. That is, the dyes exhibit a J band absorption peak attributable to their adsorbed arrangement on the tabular grain surfaces. A discussion of dye aggregation and its photographic effects is provided by James *The Theory of the Photographic Process*, 4th Ed., Macmillan, New York, 1977, in Chapter 9.

Examples of J aggregating dyes preferred for use in the practice of the invention are those satisfying the formula:

$$\begin{array}{c} \text{5IBOX}-CH=(CR-CH=)_qN_B' \\ \Updownarrow \\ \text{5IBOX}=CH-(CR=CH-)_qN_B' \end{array} \qquad \text{(XIII)}$$

where

5IBOX and R are as previously described;

q is the integer zero or 1; and $N_B'$ is a benzochalcogenazolium or naphthochalcogenazolium nucleus, where the chalcogen atom in the heterocyclic ring is chosen from among divalent oxygen, sulfur, selenium and tellurium atoms. In a specifically preferred form the invention $N_B'$ is a 5IBOX nucleus of the type described above. Since the presence or absence of the 5-iodo substituent of the benzoxazolium nucleus has little influence on aggregation, selection of J aggregating dyes satisfying the requirements of the invention can be accomplished from art knowledge of dye structures that produce aggregation. It is, of course, recognized that there are individual dye structures satisfying the general requirements of the invention beyond the bounds of formula (XIII), such as some dicarbocyanine dye structures, that exhibit J aggregation are particularly contemplated for use in the practice of this invention.

In another preferred form the 5-iodobenzoxazolium nucleus is contained in a merocyanine dye. Merocyanine dyes contain a basic nucleus, in this instance the iodobenzoxazolium nucleus, linked directly or through an even number of methine groups to an acidic nucleus. In a preferred form the merocyanine dyes useful in the practice of the invention satisfy the formula:

$$\begin{array}{c} \text{5IBOX}=(L^4-L^5=)_rN_A \\ \Updownarrow \\ \text{5IBOX}-(L^4=L^5-)_rN_A \end{array} \qquad \text{(XIV)}$$

where

5IBOX is as previously described;

$L^4$ and $L^5$ are methine groups of any of the varied forms described above;

r is the integer zero, 1 or 2; and $N_A$ is an acidic nucleus.

The acidic nucleus can be selected from among those known to be useful in merocyanine dyes. Typically acidic nuclei satisfy the formula:

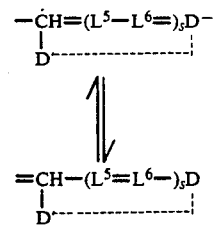

(XV)

wherein

D is a cyano, sulfo or carbonyl group;

D′ is a methine substituent of any of the various types previously described or can with D complete a five or six membered heterocyclic ring containing ring atoms chosen from the class consisting of carbon, nitrogen, oxygen, and sulfur;

$L^5$ and $L^6$ are methine groups of any of the various types previously described; and s is the integer zero or 1.

When D and D′ are independent groups, $N_A$ can be chosen from among groups such as malononitrile, alkylsulfonylacetonitrile, cyanomethyl benzofuranyl ketone, or cyanomethyl phenyl ketone. In preferred cyclic forms of $N_A$, D and D′ together complete a 2-pyrazolin-5-one, pyrazolidene-3,5-dione, imidazoline-5-one, hydantoin, 2 or 4-thiahydantoin, 2-iminooxazoline-4-one, 2-oxazoline-5-one, 2 thiooxazolidine 2,4-dione, isoxazoline-5-one, 2-thiazoline-4-one, thiazolidine-4-one, thiazolidine-2,4-dione, rhodanine, thiazolidine-2,4-dithione, isorhodanine, indane-1,3-dione, thiophene-3-one, thiophene-3-1,1-dioxide, indoline-2-one, indoline-3-one, indazoline-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinoline-4-one, 1,3-dioxane-4,6-dione, barbituric acid, 2-thiobarbituric acid, chroman-2,4-dione, indazoline-2-one or pyrido[1,2-a]pyrimidine-1,3-dione nucleus.

The photographically useful 5-iodobenzoxazolium compound is introduced into the dispersing medium in an amount sufficient to provide at least 20 percent of monomolecular coverage on the grain surfaces. It is preferred to introduce the photographically useful compound in a concentration sufficient to provide from 50 to 100 percent of monomolecular coverage. Introducing greater amounts of the photographically useful compound than can be adsorbed on grain surfaces is inefficient, since unadsorbed compound is susceptible to removal from the emulsion during subsequent washing. If higher concentrations of the 5-iodobenzoxazolium compound are desired to satisfy its photographic utility unrelated to morphological grain stabilization, further addition of the compound can be deferred until after the washing step.

It is generally preferred to dissolve in the dispersing medium of the emulsion the photographically useful compound intended to replace the 2-hydroaminoazine on the grain surfaces before protonation of the latter is undertaken. In this arrangement the compound adsorbs to the grain surfaces as the 2-hydroaminoazine vacates grain surface sites. This entirely precludes any risk of morphological degradation of the tabular grains by reversion to {100} crystal faces.

As an alternative it is specifically contemplated to lower the pH of the dispersing medium immediately before introduction of the 5-iodobenzoxazolium compound. This latter approach has the advantage of allowing divalent sulfur atom containing compounds that have limited solubility in the dispersing medium to be adsorbed to the grains in preference to precipitation within the dispersing medium. Thus, whether introduction of the 5-iodobenzoxazolium compound is optimally undertaken before or after the pH is lowered is a function of the particular compound being employed and particularly its solubility and rate of precipitation.

As previously indicated, the photographically useful compound is preferably introduced into the dispersing medium and the pH of the dispersing medium is reduced before emulsion washing, so that the released protonated 2-hydroaminoazine can be removed from the emulsion without undertaking a second washing step. The 2-hydroaminoazine can be released from the grain surfaces before or after chemical sensitization. The addition of a photographically useful compound, such as a spectral sensitizing dye or antifoggant, to an emulsion before chemical sensitization is a common practice and entirely compatible with the practice of this invention.

Apart from the features of the invention that have been specifically described, the emulsions and their preparation can take any convenient conventional form. *Research Disclosure,* Vol. 308, December 1989, Item 308119, is here incorporated by reference for its disclosure of conventional emulsion features, and attention is specifically directed to Sections IV, VI and XXI.

EXAMPLES

The invention can be better appreciated by reference to the following specific embodiments.

Host Emulsion A. AgCl Tabular-Grain Emulsion

To a reaction vessel containing 10 L of a stirred solution at pH 6.0 and at 40° C. that was 2% in bone gelatin, 1.5 mM in 4,5,6-triaminopyrimidine, 0.040M in NaCl, and 0.20M in sodium acetate were added 4M $AgNO_3$ solution and 4.5M NaCl solution. The $AgNO_3$ solution was added at 6.25 mL/min for 1 min then its flow rate was accelerated to 110 mL/min during a period of 30 min and finally held constant at 110 mL/min until a total of 6.7 moles of $AgNO_3$ had been added. The 4.5M NaCl solution was added at a rate needed to maintain a constant pAg of 7.67. After the precipitation was complete, 133 g of phthalated gelatin was added. The resulting nonwashed high aspect ratio AgCl tabular grain emulsion consisted of a tabular grain population which made up 85% of the total projected area of the grains. The tabular-grain population had a mean equivalent circular diameter of 1.3 μm, a mean thickness of 0.085 μm, and an average aspect ratio of 15.3.

Example 1 Testing Dyes for Stabilizing AgCl Tabular Grain Morphology

To 0.02M of stirred Host Emulsion A at 40° C. was added a solution of anhydro-5,5′-diiodo-9-ethyl-3,3′-di(3-sulfopropyl)oxacarbocyanine hydroxide, sodium salt in an amount noted in Table I. The mixture was stirred for 5 min at 40° C. then diluted with distilled water to 250 ml and the pH was lowered to 3.5 with $H_2SO_4$. After standing for 2 hrs at 2° C., the solid phase was resuspended in a solution that was 1% in gelatin and 4 mM in NaCl to a total weight of 40 g. Samples were examined by optical and electron microscopy to determine if the dye functioned as a AgCl {111} tabular grain stabilizer.

Stabilizer Test Criteria

The compound of interest was considered to be a AgCl {111} tabular grain stabilizer if after acid washing the emulsion to remove the growth modifier, the original tabular grain population did not increase in mean thickness by more than 50%. For these examples that use Host Emulsion A, the mean tabular grain thickness of the acid washed emulsion must not exceed 0.128 μm for the stabilizer to be considered effective.

TABLE I

| Emulsion | Stabilizer Amount mmol/Ag mol | Stabilizer Amount Approx Monolayer Coverage | Tabular Grain Emulsion Stabilized |
|---|---|---|---|
| Example 1a | 1.5 | 100% | Yes |
| Example 1b | 0.75 | 50% | Yes |
| Example 1c | 0.375 | 25% | Yes |
| Control 1d | 0.0 | 0% | No |

Example 2 Testing Dyes for Stabilizing AgCl Tabular Grain Morphology Having High Bromide Corner Epitaxy To a reaction vessel containing 100 g (0.04 mol) of stirred Host Emulsion A at 25° C. was added 0.8 mmol of a 0.2M NaBr solution at a rate of 1 ml/min (calculated growth rate of $3.1\times10^{-18}$ mol epitaxy/corner.-min, where each corner is considered to be formed by both major faces of each tabular grain). Then 1.5 mmol-/Ag mol of the dye stabilizer to be tested dissolved in a solvent was added and the temperature was increased to 40° C. After 5 min at 40° C., 500 ml of distilled water was added. The pH was dropped to 3.5 and the emulsion was allowed to settle for 2 hrs at 2° C. The solid phase was resuspended in a solution that was 1% in gelatin and 4 mM in NaCl to a total weight of 80 g. The pH was adjusted to 5.5 at 40° C. Electron and optical photomicrographs were examined to determine if the proposed stabilizer was effective using the criteria given in Example 1.

Figure 2:
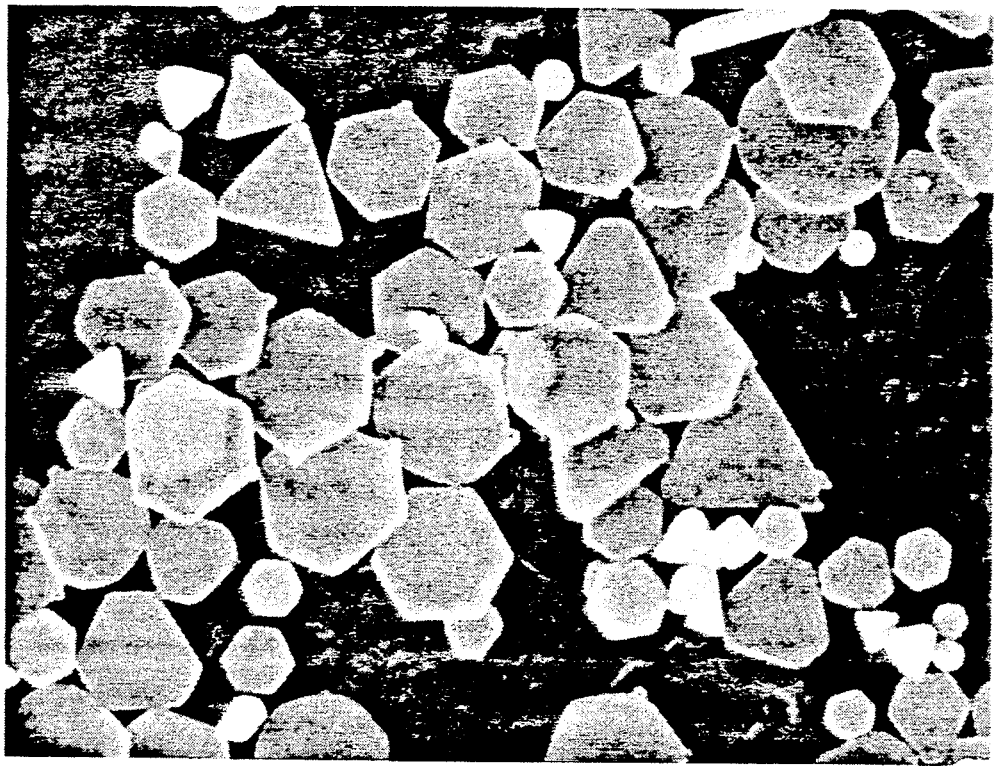
FIG. 2—Scanning electron photomicrograph viewed perpendicular to the support of Example Emulsion 2f.
Figure 3:
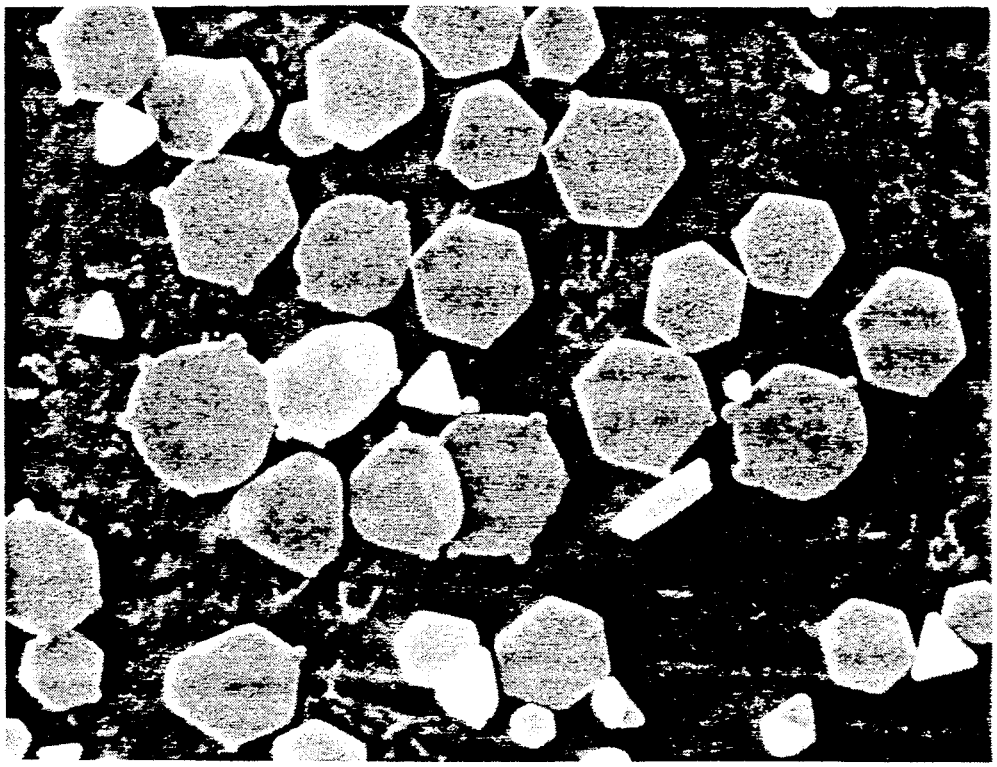
FIG. 3—Scanning electron photomicrograph viewed perpendicular to the support of Example Emulsion 2f after heating for 5 min at 65° C.
Figure 4:
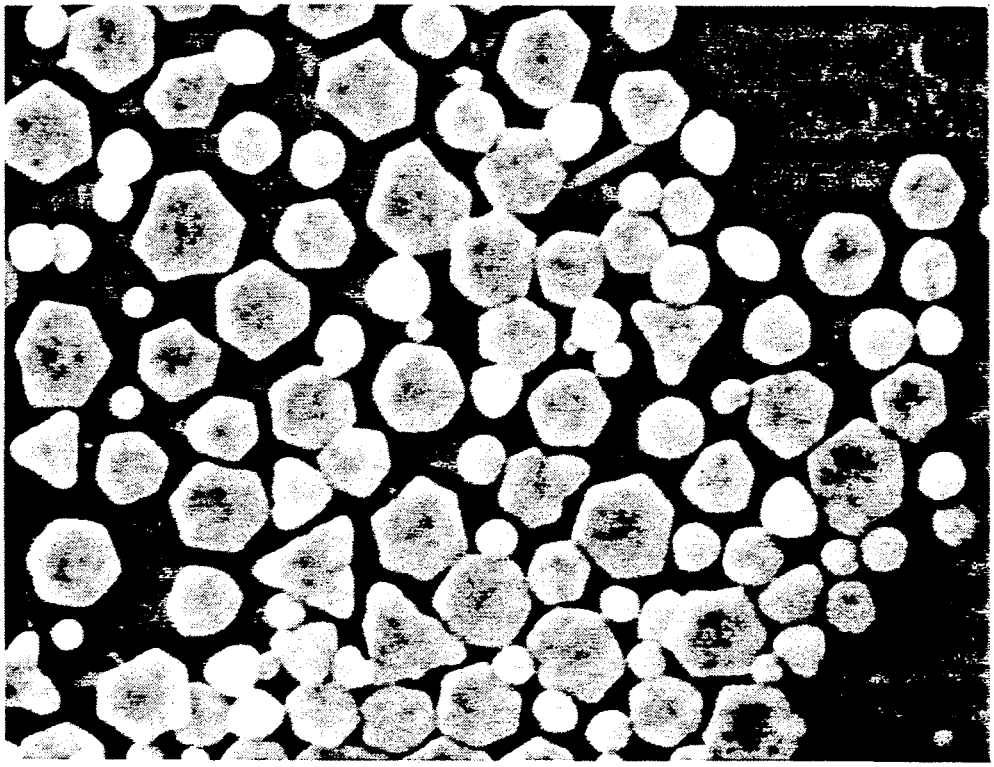
FIG. 4—Scanning electron photomicrograph viewed perpendicular to the support of Control Emulsion 2e.
Figure 5:
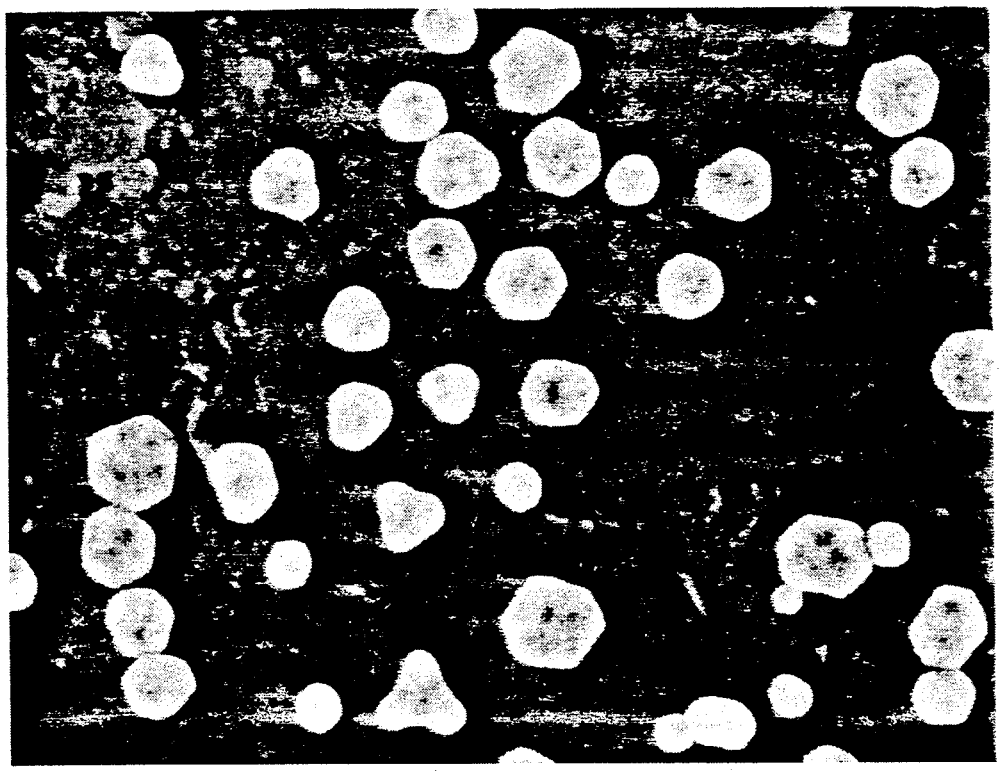
FIG. 5—Scanning electron photomicrograph viewed perpendicular to the support of Control Emulsion 2e after heating for 5 min at 65° C.

As shown in Table II, only the oxacarbocyanine dyes having at least one iodo substituent in a 5 ring position were found to be stabilizers. Portions of the stabilized Emulsions 2c, 2f, and 2g, and a portion of the nonstabilized Emulsion 1e were heated for 5 min at 65° C. to further test their stability. The high aspect of the ratio tabular grain morphology was preserved for Emulsions 2c, 2f, and 2g while Emulsion 2e continued to ripen and lose tabularity. The results are shown in FIGS. 1 to 5 inclusive.

TABLE II

| Emulsion | Possible Stabilizer Tested | 40° C. Tabular Grains Stabilized | 65° C. Tabular Grains Stabilized |
|---|---|---|---|
| Control 2a | anhydro-5,5'-dichloro-9-ethyl-3,3'-di(3-sulfopropyl)oxacarbocyanine hydroxide, sodium salt | No | — |
| Control 2b | anhydro-5,5'-dibromo-9-ethyl-3,3'-di(3-sulfopropyl)oxacarbocyanine hydroxide, sodium salt | No | — |
| Example 2c | anhydro-5,5'-diiodo-9-ethyl-3,3'-di(3-sulfopropyl)oxacarbocyanine hydroxide, sodium salt | Yes | Yes |
| Control 2d | anhydro-5,5'-diphenyl-9-ethyl-3,3'-di(3-sulfopropyl)oxacarbocyanine hydroxide, sodium salt | No | — |
| Control 2e | anhydro-5,5'-diphenyl-9-ethyl-3,3'-di(3-sulfoethyl)oxacarbocyanine hydroxide, pyridinium salt | No | — |
| Example 2f | anhydro-5-iodo-5'-(2-pyrrolecarboxamido)-9-ethyl-3,3'-di-(3-sulfopropyl)oxacarbocyanine hydroxide, sodium salt* | Yes | Yes |
| Control 2g | 5,5'-diiodo-3,3'-dimethylthiacarbocyanine trifluoromethanesulfonate | Yes | Yes |
| Control 2h | no added stabilizer | No | — |

*This dye was added as a partial suspension in dimethylformamide.

Example 3 Measure Spectrally Sensitized Photographic Response

A control emulsion was prepared which was an AgBr tabular-grain emulsion consisting of grains having a mean diameter of 1.7 μm and a mean thickness of 0.085 μm and spectrally sensitized with 1.5 mmol/Ag mol of anhydro-5,5'diiodo-9-ethyl-3,3'-di(3-sulfopropyl) oxacarbocyanine hydroxide, sodium salt to make Control Emulsion 3a.

To portions of Control Emulsion 3a and Example Emulsion 1c were added 5 mg/mol of $Na_2S_2O_3$ and 5 mg/mol of $KAuCl_4$ and then they were heated for 5 min at 65° C. to make Control Emulsion 3ax and Example Emulsion 3ex. Then 1.0 mmol/Ag mol of 1-(3-acetamidophenyl)-5-mercaptotetrazole was added to Example Emulsion 3ex.

Control Emulsions 3a and 3ax and Example Emulsion 3ex were coated onto polyester film support at 2.15 g Ag/m$^2$ and 4.20 g gelatin/m$^2$ and hardened with bis(-vinylsulfonylmethyl) ether to make coatings 3A, 3AX, and 3EX. The coatings were exposed for 0.5 sec to a 600 W, 3,000K tungsten light source through a Kodak Wratten 9 TM yellow filter and a 0–4.0 density step-tablet. The exposed coatings were developed for 1 min in Kodak Developer DK-50 TM at 20° C. The results are given in Table III. Note that the example coating, Coating 3EX, had a higher minus blue speed than did the chemically sensitized control coating, Coating 3AX.

TABLE III

| Coating | Emulsion | Sulfur-Gold Treated | Absorptance Maxima of Coatings (nm) | $D_{min}$ | $D_{max}$ | Relative Speed |
|---|---|---|---|---|---|---|
| 3A | Control Emulsion 3a | No | 545 | 0.08 | 1.90 | 100 |

TABLE III-continued

| Coating | Emulsion | Sulfur-Gold Treated | Absorptance Maxima of Coatings (nm) | $D_{min}$ | $D_{max}$ | Relative Speed |
|---|---|---|---|---|---|---|
| 3AX | Control Emulsion 3ax | Yes | 546 | 0.16 | 2.64 | 720 |
| 3EX | Example Emulsion 3ex | Yes | 544 | 0.16 | 2.68 | 870 |

The invention has been described in detail with particular reference to preferred embodiments thereof, but it will be understood that variations and modifications can be effected within the spirit and scope of the invention.

What is claimed is:

1. A process of preparing an emulsion for photographic use comprising (1) forming an emulsion comprised of silver halide grains and a gelatino-peptizer dispersing medium in which morphologically unstable tabular grains having {111} major faces account for greater than 50 percent of total grain projected area and contain at least 50 mole percent chloride, based on silver, the emulsion additionally containing at least one 2-hydroaminoazine adsorbed to and morphologically stabilizing the tabular grains, and (2) adsorbing to surfaces of the tabular grains a photographically useful compound, wherein (a) 2-hydroaminoazine adsorbed to the tabular grain surfaces is protonated and thereby released from the tabular grain surfaces into the dispersing medium, (b) the released 2-hydroaminoazine is replaced on the tabular grain surfaces by adsorption of a photographically useful 5-iodobenzoxazolium compound, thereby concurrently morphologically stabilizing the tabular grains and enhancing their photographic utility, and (c) released 2-hydroaminoazine is removed from the dispersing medium.

2. A process according to claim 1 in which the tabular grains are chemically sensitized prior to releasing the 2-hydroaminoazine from their surfaces.

3. A process according to claim 1 in which the photographically useful compound is present in the emulsion prior to releasing the protonated 2-hydroaminoazine.

4. A process according to claim 3 in which the emulsion is chemically sensitized after the protonated 2-hydroaminoazine is released from grain surfaces.

5. A process according to claim 1 in which the photographically useful 5-iodobenzoxazolium compound is a spectral sensitizing dye.

6. A process according to claim 5 in which the spectral sensitizing dye is a polymethine dye.

7. A process according to claim 6 in which the spectral sensitizing dye is a cyanine or merocyanine dye.

8. A process according to claim 7 in which the spectral sensitizing dye is a cyanine dye containing two 5-iodobenzoxazolium nuclei.

9. A process according to claim 7 in which the spectral sensitizing dye is adsorbed to the tabular grain surfaces in an aggregated form.

10. A process according to claim 1 in which the 2-hydroaminoazine is selected from the group consisting of

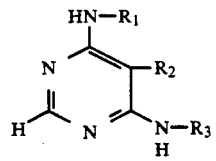

(A)

wherein $R_1$, $R_2$ and $R_3$ are, independently, H or alkyl of to 5 carbon atoms; $R_2$ and $R_3$ when taken together are $—CR_4{=}CR_5—$ or $—CR_4{=}N—$, wherein $R_4$ and $R_5$ are, independently, H or alkyl of 1 to 5 carbon atoms, with the proviso that when $R_2$ and $R_3$ taken together form the $—CR_4{=}N—$ linkage, $—CR_4{=}$ must be joined to the ring at the $R_2$ bonding position;

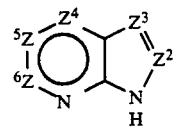

(B)

where $Z^2$ is $—C(R^2){=}$ or $—N{=}$;

$Z^3$ is $—C(R^3){=}$ or $—N{=}$;

$Z^4$ is $—C(R^4){=}$ or $—N{=}$;

$Z^5$ is $—C(R^5){=}$ or $—N{=}$;

$Z^6$ is $—C(R^6){=}$ or $—N{=}$;

with the proviso that no more than one of $Z^4$, $Z^5$ and $Z^6$ is $—N{=}$;

$R^2$ is H, $NH_2$ or $CH_3$;

$R^3$, $R^4$ and $R^5$ are independently selected, $R^3$ and $R^5$ being hydrogen, halogen, amino or hydrocarbon and $R^4$ being hydrogen, halogen or hydrocarbon, each hydrocarbon moiety containing from 1 to 7 carbon atoms; and $R^6$ is H or $NH_2$;

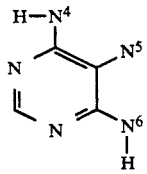

(C)

where $N^4$, $N^5$ and $N^6$ are independent amino moieties; and

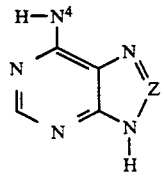

(D)

where $N^4$ is an amino moiety and

Z represents the atoms completing a 5 or 6 member ring.

11. A process according to claim 1 wherein the released 2-hydroaminoazine is replaced on the tabular grain surfaces by adsorption of a 5-iodobenzoxazolium nucleus of a photographically useful compound.

12. A process according to claim 1 wherein the 5-iodobenzoxazolium compound is a dye satisfying the formula:

$$5IBOX—L^1=(L^2—L_3=)_p5IBOX$$

where $L^1$, $L^2$ and $L^3$ are —CR= groups;

p is the integer zero, 1 or 2;

R is hydrogen or a hydrocarbon of from 1 to 6 carbon atoms; and

5IBOX satisfies the formula:

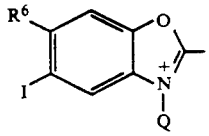

wherein

Q is a quaternizing substituent and $R^6$ is hydrogen, halogen or a substituted or unsubstituted hydrocarbon of from 1 to 2 carbon atoms.

* * * * *